United States Patent [19]

Elze

[11] 4,070,844

[45] Jan. 31, 1978

[54] SPRING LOADED CAM LOCK

[76] Inventor: Karl H. Elze, Rte. 3, Box 255, Minden, Nev. 89423

[21] Appl. No.: 714,839

[22] Filed: Aug. 16, 1976

[51] Int. Cl.[2] ..... E04C 1/10

[52] U.S. Cl. ..... 52/584; 52/127; 52/595

[58] Field of Search ..... 52/583, 584, 127, 586, 52/595

[56] References Cited

U.S. PATENT DOCUMENTS

| | | | |
|---|---|---|---|
| 2,373,409 | 4/1945 | Myer | 52/583 |
| 3,088,178 | 5/1963 | Propst | 52/584 |
| 3,641,720 | 2/1972 | Berrie | 52/220 |
| 3,742,672 | 7/1973 | Schaeufele | 52/595 |

FOREIGN PATENT DOCUMENTS

| | | | |
|---|---|---|---|
| 544,862 | 2/1956 | Belgium | 52/583 |
| 613,647 | 12/1960 | Italy | 52/584 |

*Primary Examiner*—Ernest R. Purser
*Assistant Examiner*—Henry Raduazo
*Attorney, Agent, or Firm*—Clarence A. O'Brien; Harvey B. Jacobson

[57] ABSTRACT

A spring loaded cam lock for attaching together structural components has a pair of cooperating keeper arrangements each connected to a respective structural component and selectively held together by a torsion bar. By providing the torsion bar with a substantially elliptical cross section and the keeper arrangements with spring plates having substantially circular openings, the torsion bar can be restrained against sliding movement along its longitudinal extent and the openings provided in the spring plates brought into substantial alignment by rotation of the torsion bar about its longitudinal axes.

1 Claim, 9 Drawing Figures

SPRING LOADED CAM LOCK

BACKGROUND OF THE INVENTION

1. Field of the Invention

This invention relates generally to fastening devices, and particularly to a spring loaded cam lock for attaching together structural components such as prefabricated sections of a building structure.

2. Description of the Prior Art

A problem arises in the manufacture and erection of prefabricated buildings as to attachment of the various components of the building to one another at the erection site. Since many prefabricated buildings are intended for only temporary use, the devices which attach the components to one another must permit not only rapid connection when the building is being erected, but equally rapid disassembly for permitting the components to be disconnected from one another during disassembly.

Examples of connectors previously proposed for connecting together structural components such as those used in erecting prefabricated buildings can be found in U.S. Pat. Nos. 2,114,770, issued Apr. 19, 1938 to G. E. Shipway et al.; 3,271,056, issued Sept. 6, 1966 to G. W. Frisbey, Jr.; 3,323,819, issued June 6, 1967 to L. C. Barker; 3,415,026, issued Dec. 10, 1968 to P. W. Tillisch et al; and 3,511,004, issued May 12, 1970 to A. K. Snellings.

SUMMARY OF THE INVENTION

It is an object of the present invention to provide a rapid and positive device for attaching structural components such as walls, ceilings, and roofs to one another and to foundations during the construction of any type of building or structure where such walls, ceilings, and roofs are prefabricated at locations other than the building site.

It is another object of the present invention to provide a spring loaded cam lock system specifically for prefabricated building structures, and the like, which permits fast disassembly of the structure or structures in the event that same are only temporary. This feature is especially desirable in conjunction with the use of emergency shelter or storage structures which required different locations from time-to-time.

These and other objects are achieved according to the present invention by providing an attachment system which has: a first keeper arrangement connected to a first structural component; a second keeper arrangement connected to a second structural component to be attached to the first structural component; and a bolt device disposed engaging the first keeper arrangement and the second keeper arrangement for connecting together the keeper arrangements and, accordingly, the structural components associated with the keeper arrangements.

Each keeper arrangement advantageously includes a spring lock provided with an opening, with the bolt device including a torsion bar inserted into the openings of each of the keeper arrangements. The torsion bar preferably is a longitudinally extending element having an elliptical cross section. Thus, when the longest dimension of the cross section of the torsion bar is disposed transverse of the longitudinal extent of spring plates associated with the spring locks and in which the openings of the spring locks are provided the torsion bar will be somewhat loose with respect to the openings, which will be offset slightly from one another, and the torsion bar can be longitudinally displaced with respect to the keeper arrangements for assembly and disassembly of the lock. Conversely, when the torsion bar is rotated 90° about its longitudinal axis, the openings will be brought into alignment with one another by positioning of the longest dimension of the cross section of the torsion bar substantially parallel to the longitudinal extent of the spring plates of the spring lock, and the torsion bar will be wedged against the peripheries of the openings provided in the spring plates for preventing longitudinal displacement of the torsion bar relative to the spring locks.

Each of the keeper arrangements advantageously further includes a channel including a web and a pair of spaced depending codirectional legs, the spring locks are mounted on the web so as to extend codirectionally with the legs, with the legs arranged for abutting one another when the channels are in a position corresponding with the locked mode of the cam lock so that the spring lock of one of the channels extends toward the web of the other of the channels. It is the channels which are mounted on a respective structural component so that the structural components are attached to one another when the cam lock is in its locked mode.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
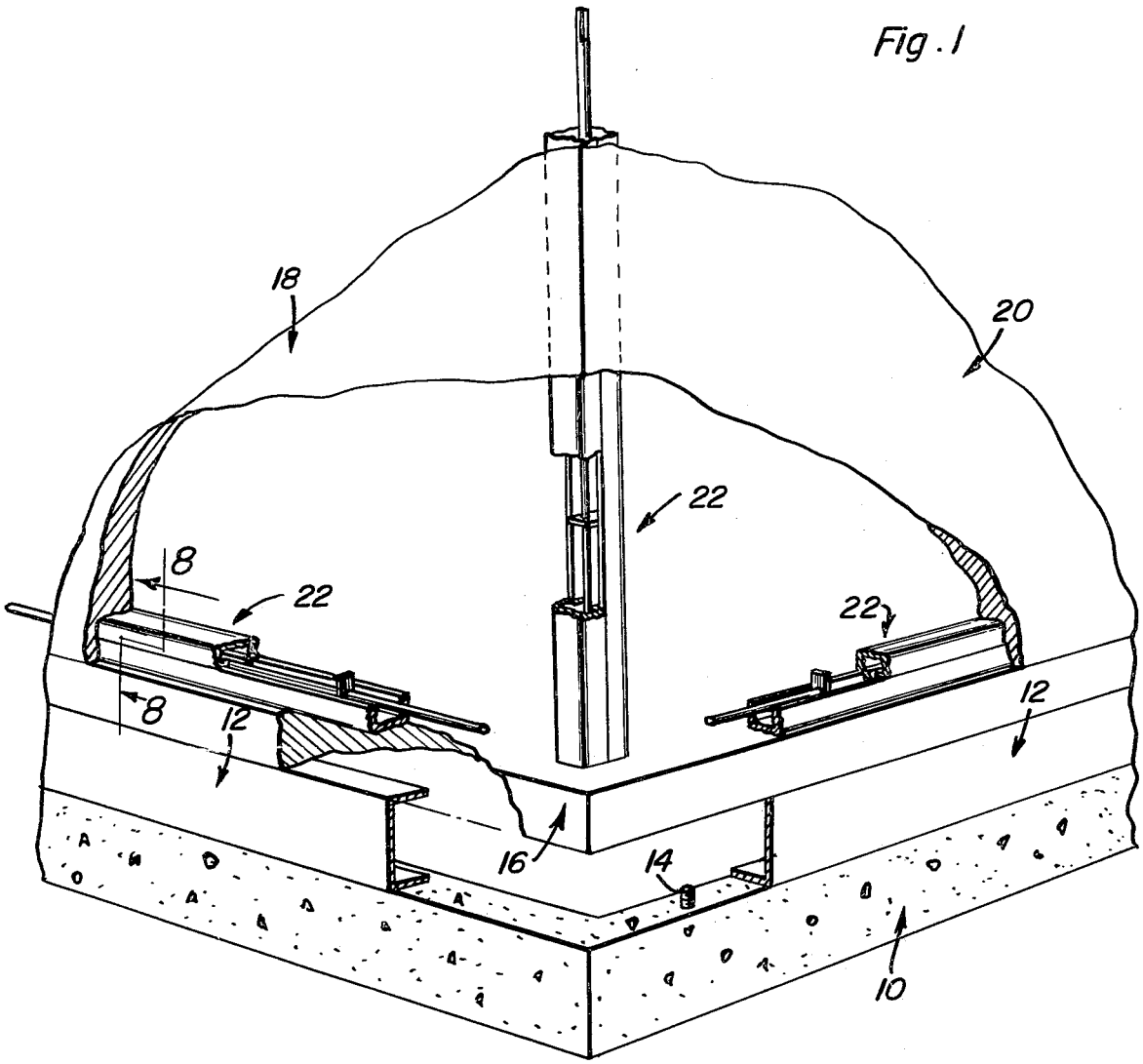
FIG. 1 is a fragmentary, perspective view showing cam locks according to the present invention attaching together various components of a building structure.

Referring now more particularly to FIG. 1 of the drawings, prefabricated structural components are disposed on a foundation 10 which supports a pair of conventional channels or "C" beams 12. Studs 14 are provided embedded in foundation 10 for attachment of beams 12 to the foundation, while a prefabricated floor panel 16, and the like, is disposed resting on the beams 12. Wall panels 18 and 20 are attached to floor panel 16 and to one another by the use of spring loaded cam locks 22 according to the present invention. As can be seen from FIG. 1, these cam locks 22 can be attached to the associated structural members as by being embedded therein, or they can be fastened in a conventional manner by suitable fasteners such as bolts, rivets, and the like.

Referring now more particularly to FIGS. 2 through 7 of the drawings, each of the cam locks 22 includes a first keeper arrangement 24 connected to a first structural component, such as a floor panel 16 or wall panel 18, 20, and a second keeper arrangement 26 connected to a second structural component and selectively attachable to the first keeper arrangement 24 as by a bolt device preferably in the form of the illustrated torsion bar 28 which engages the keeper arrangements 24 and 26 for connecting together these arrangements and their associated structural components.

Each of the keeper arrangements 24 and 26 includes a channel 30 and 32, respectively. Channel 30 is formed by a web 34 and a pair of spaced, codirectionally depending legs 36 and 38, while the channel 32 includes a web 40 and a pair of spaced, codirectionally depending legs 42 and 44. Legs 42 and 44 are provided with offset extensions 46 and 48 which will permit the channel 32 to interengage with the channel 30 in a guiding manner which assures a proper interrelationship between the channels 30 and 32 when the associated cam lock 22 is in its locked position.

Each of the keeper arrangements 24 and 26 also includes at least one and preferably the illustrated plurality of spring locks 50 and 52, respectively. Each of the spring locks 50 includes a spring plate 54 extending longitudinally from the web 34 of the associated channel 30 and provided with a substantially circular opening 56. The plate 54 is attached to the web 34 by a pair of oppositely directed feet 58 and 60. Attachment of the 58 feet and 60 is made in a suitable manner, such as by welding along a predetermined portion of the surface area of the feet 58 and 60.

In a similar manner to the spring locks 50, the spring locks 52 each includes a longitudinally extending plate 62 provided with an opening 64 and a pair of oppositely directed feet 66 and 68 attached to the web 40 of the associated channel 32. The openings 56 and 64 provided in the spring plates 54 and 62, respectively, are so arranged as to permit the torsion bar 28 to slide through these openings 56, 64 when the associated cam lock 22 is being assembled and disassembled.

Figure 8:
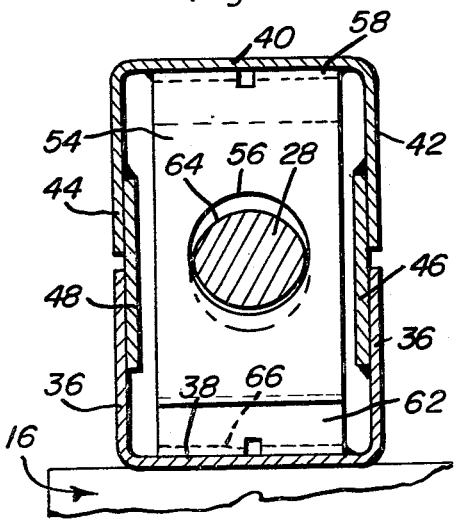
FIG. 8 is an enlarged, fragmentary, sectional view taken generally along the line 8—8 of FIG. 1, but showing the cam lock in its unlocked mode.
Figure 9:
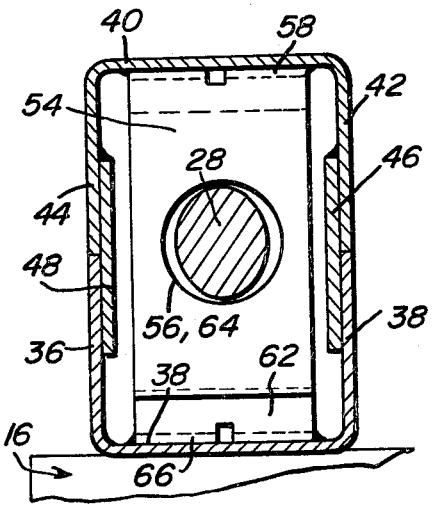
FIG. 9 is a fragmentary, sectional view similar to FIG. 8, but showing the cam lock in its locked mode or position.
Figures 2, 3, 4, 5, 6, 7:
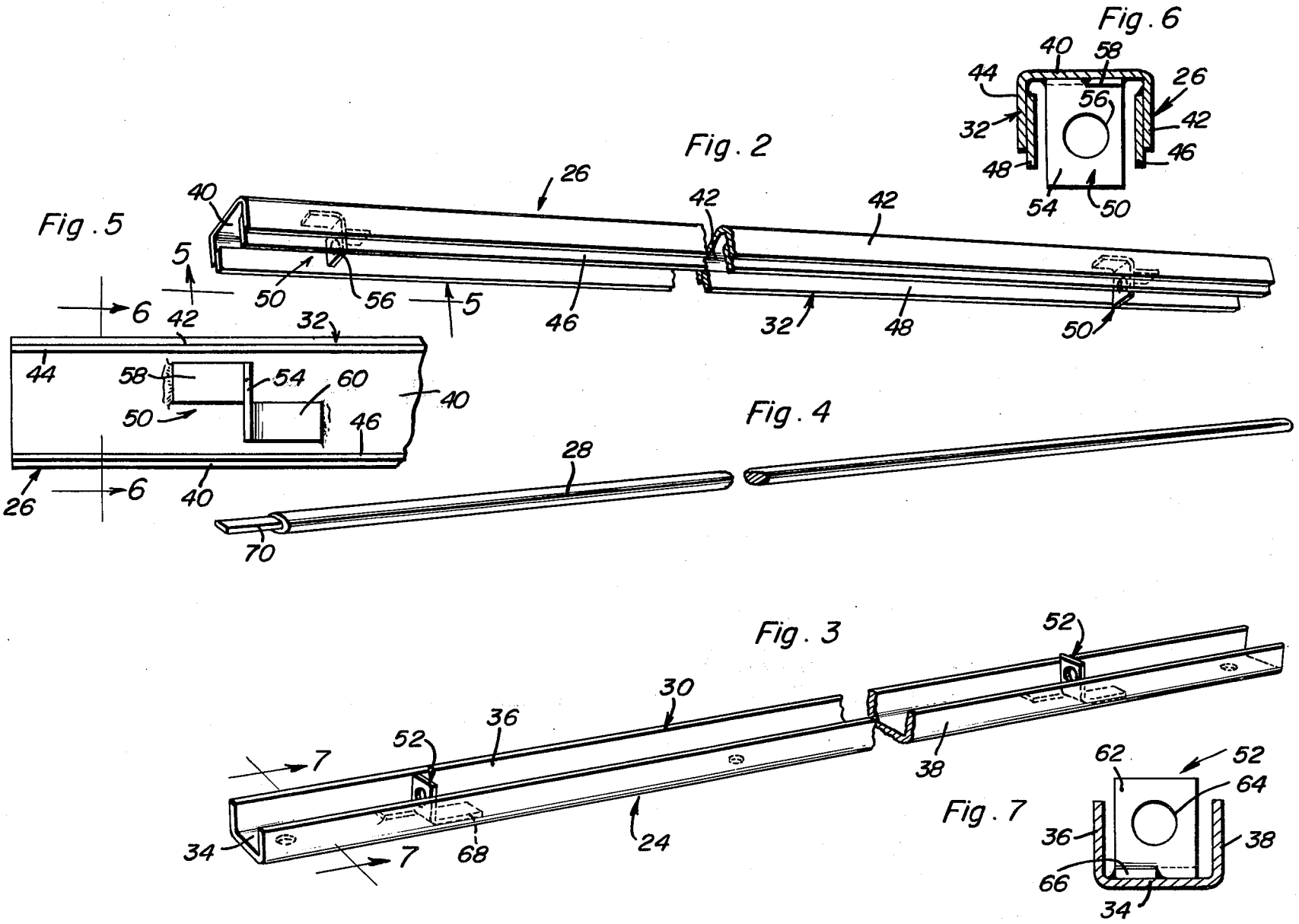
FIG. 2 is a fragmentary, perspective view showing one part of one of the cam locks as seen in FIG. 1.
FIG. 3 is a fragmentary, perspective view showing one part of the one of the cam locks as seen in FIG. 1.
FIG. 4 is a fragmentary, perspective view showing yet another part of the one of the cam locks as seen in FIG. 1.
FIG. 5 is an enlarged fragmentary, plan view taken in the direction of the arrows 5—5 in FIG. 2.
FIG. 6 is a sectional view taken generally along the line 6—6 of FIG. 5.
FIG. 7 is a sectional view taken generally along the line 7—7 of FIG. 3.

Torsion bar 28 is advantageously the illustrated longitudinally extending element having an elliptical cross section, as can be seen best in FIGS. 8 and 9 of the drawings. When the torsion bar 28 is disposed as shown in FIG. 8 with the longest dimension of the elliptical cross section disposed transverse of the longitudinal extent of the spring plates 54 and 62 from their respective webs 34 and 40 toward the other of the webs 40, 34, the torsion bar 28 is permitted to slide along its longitudinal extent. As can be seen from FIG. 8, the openings 56 and 64 are slightly offset from one another along the direction between the webs 34 and 40. When the torsion bar 28 is rotated substantially 90 degrees from the position shown in FIG. 8 to the position shown in FIG. 9, the longest dimension of the elliptical cross section of the torsion bar 28 will now be substantially parallel to the longitudinal extent of the plates 54 and 62, and the openings 56 and 64 will be brought into substantial alignment with one another. Thus, FIG. 9 shows the locked mode or position of the associated cam lock 22. Rotation of the torsion bar 28 is facilitated by provision of a standard fitting 70 at one end of the bar 28 for receiving a conventional torque transmitting tool (not shown) such as a wrench.

As will be appreciated, the openings 56 provided on a common channel 30 are all in substantial alignment with one another, as are the openings 64 provided on a channel 32.

A particularly advantageous feature of the invention is that the amount of spring tension, as well as the allowable misalignment when inserting the torsion bar 28 in the openings 56, 64, is determined by the length of the, for example, welded area of the feet 58, 60 and 66, 68 as a proportion of the total length of these feet. The lower the spring area the more misalignment permitted. The deflection of the spring area of each spring lock 50, 52 insures metal-to-metal contact between each spring lock and the torsion bar, or cam lock element, when the torsion bar 28 is inserted in the openings 56, 62. This arrangement takes up any irregularities in the box beam formed by the channels 30 and 32.

Following the insertion of the full length of the torsion bar 28 through all of the openings 56, 62 of the spring locks 50, 52, metal-to-metal contact is insured between each spring lock 50, 52 and the torsion bar 28. This is the FIG. 8 position. The torsion bar 28 is then rotated 90 degrees in order to cam the plates 54, 62 toward one another and lock the torsion bar 28 in place. This rotation causes the elliptical cross section of the torsion bar 28 to exert a calculated force in the opposite direction of each alternate spring lock 50, 52.

Each welded area of each spring lock 50, 52 is now under tension. The length of each welded area, plus the thickness of the spring lock material, or the thickness of the feet 58, 60 and 66, 68, will determine the maximum tension strength available. Additionally, the number of spring locks 50, 52 per length of beam, or channels 30, 32 will also be a factor in available strength.

Following insertion and rotation of the torsion bar 28, or cam lock element, the main force will now be translated, through the spring locks 50, 52, to the back sections, or webs 34, 40 of both halves or channels 30, 32 of the resulting box beam. These sections may be designed to accommodate some deflection, or no deflection whichever is called for by the design of the structure.

As can be appreciated from the above description and from the drawings, the present invention offers flexibility and simplicity far above any other known devices for attaching together structural components. Further, greater strength is achieved with more margin for error in the field assembly. Walls, ceilings, floors, and roofs can be better produced in a factory under quality controlled conditions. Most importantly, the principal problem of field assembly of prefabricated components is greatly facilitated by the use of the present invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with first and second structural components, a spring loaded cam lock for attaching the components together, the lock comprising, in combination:

a. first keeper means connected to the first structural component;

b. second keeper means connected to the second structural component; and c. bolt means engaging the first keeper means and the second keeper means for connecting together the keeper means and the first structural component and second structural component, each of the keeper means including a spring lock provided with a substantially circular opening, and the bolt means including a torsion bar inserted in the opening of each of the keeper means for camming the inner locks relative to one another, the torsion bar being longitudinally extending and having a non-circular cross section forming a longest dimension, with the torsion bar being restrained against longitudinal movement by a 90° rotation of the bar from a position with the longest dimension of the cross section of the bar disposed transverse of the longitudinal extent of the spring locks to a position with the longest dimension parallel to the longitudinal extent of the spring locks, which cams the openings of the spring locks of the first keeper means and the second keeper means into substantial alignment with one another, the keeper means each including a channel including a web and a pair of spaced, codirectionally depending legs, and a spring lock mounted on the web and extending codirectionally with the legs, and offset extensions provided on the legs of only one of the channels and arranged for permitting the channels to interengage with one another, the spring lock being provided with an opening arranged for receiving the bolt means, the channel of each of the keeper means being mounted on a respective one of the first structural component and the second structural component, each of the keeper means including a plurality of generally planar spring locks provided with openings substantially coaxially to one another, with the planes of each of the spring locks being substantially parallel to one another with each of the keeper means including a plurality of the spring locks spaced along the associated channel and provided with openings substantially coaxial to one another.

* * * * *